US007891831B2

(12) United States Patent
Chen

(10) Patent No.: US 7,891,831 B2
(45) Date of Patent: Feb. 22, 2011

(54) SELF-ILLUMINATION GLOVE

(76) Inventor: Hui Lin Chen, 4335 Rowland Ave., El Monte, CA (US) 91731

( * ) Notice: Subject to any disclaimer, the term of this patent is extended or adjusted under 35 U.S.C. 154(b) by 186 days.

(21) Appl. No.: 12/284,096

(22) Filed: Sep. 17, 2008

(65) Prior Publication Data

US 2009/0219709 A1 Sep. 3, 2009

Related U.S. Application Data

(60) Provisional application No. 61/067,951, filed on Mar. 3, 2008.

(51) Int. Cl.
*F21V 33/00* (2006.01)
*A41D 19/00* (2006.01)

(52) U.S. Cl. ..... 362/103; 362/198; 2/160

(58) Field of Classification Search ..... 362/103, 362/198, 800; 2/160
See application file for complete search history.

(56) References Cited

U.S. PATENT DOCUMENTS 5,450,293 A * 9/1995 Hoffman ..... 362/570
6,892,397 B2 * 5/2005 Raz et al. ..... 2/160
6,902,289 B1 * 6/2005 Smith ..... 362/103
7,347,578 B1 * 3/2008 Nourse ..... 362/103
2004/0223321 A1 * 11/2004 Crowley ..... 362/103
2008/0062676 A1 * 3/2008 Masuda ..... 362/103
2009/0168407 A1 * 7/2009 Wright ..... 362/103

* cited by examiner

*Primary Examiner*—Stephen F. Husar
*Assistant Examiner*—Peggy A. Neils
(74) *Attorney, Agent, or Firm*—Raymond Y. Chan; David and Raymond Patent Firm

(57) ABSTRACT

A self-illumination glove for use in poor visibility or dim conditions, the orientation of the light head is adjustable to prevent the light being blocked by the hand movement. The glove body is adapted for load and unloads an illumination unit. The illumination unit includes at least one flexible arm which is extended along and above the dorsum side of the glove body from the power source to the light head and out of the outer glove layer through the through slot, such that the light head is selectively adjusted the orientation when the bendable portion of the flexible arm is adjustably bent.

18 Claims, 3 Drawing Sheets

SELF-ILLUMINATION GLOVE

CROSS REFERENCE OF RELATED APPLICATION

This is a non-provisional application of a provisional application having an application 61/067,951 and a filing date of Mar. 3, 2008.

BACKGROUND OF THE PRESENT INVENTION

1. Field of Invention

The present invention relates to a utility glove, and more particularly to a glove with self-illumination arrangement for use in poor visibility or dim conditions, the orientation of the light head is adjustable to prevent the light being blocked by the hand movement.

2. Description of Related Arts

Gloves can put to use to protect the hands of the wearer against frost environment, high temperature, friction burn, abrasion, chemicals or disease; to cut a long story short the purpose of the glove is to provide a guard for what a bare hand should not touch. People use gloves in different purposes and varied tasks everyday. In some situation, people such as cable technicians and mechanics had no choice but to work under dim environment with poor light source. Holding a light source such as flashlight is generally used in order to have a clear look at the target in the dim environment. However, it is nearly impossible for those technicians or mechanics to use only one hand to handle or operate complex proceed while they have to hold a light source on one hand.

Some workers or mechanics preferred to use headlamp instead of hand holding light sources. It cannot be denied that the headlamp actually helps those people could work with both hands to increase work efficiency. However, the headlamp cannot go deep into the narrow area and pin-point the target, for example, mechanic usually needs to repair or maintain some mechanism which is block by other mechanism or located in the bowel of complex structures, it is not efficient for headlamp to pin-point the target in those situations. Besides, because the headlamp was firmly fixed on user's head, so the user needs to twist their neck to make the light strike on the target area. It is very uncomfortable for the user and even has the chance to sprain their neck if someone has to wear the headlamp and work for a long time. Also, the light source was from the top of the user's head, when working in the dark area the movement of the user's hands and arms might block the light. This situation was unavoidable.

In order to solve those problems, some devices have been developed to having a light source located at the user's hand, the conventional way is mounting an illumination device on the gloves so that the users can easily put it on or took it off. The use of the gloves with illumination device is known in the prior art. By this way, users can operate with their both hands and makes the light source reach the target located in the narrow area. However, the major drawback of those kinds of illumination gloves is that the directions and angles of the light beam are fugitive and astatic. The light sources are located on the outer surface of those gloves and directly projected from the outer surface of the glove. Accordingly, the hand movement could effect the direction of the light. In other word, the direction and angle of the light are changed with user's hand movement. The astatic orientation of light beam cannot do anything to help the users to illuminate the target area in dim environment while they have to move their hands to operate something. Besides, the users have to change the angle of their wrists or arms to adjust the direction of the light beam to target the area they want. It will be difficult for the users to exert all their strength or operated complex proceed while their wrists or arms are in an irregular posture.

SUMMARY OF THE PRESENT INVENTION

A main object of the present invention is to provide a self-illumination glove, which comprises at least one flexible arm extended to the light source from the power source, to make the light beam exactly pin-point the target area by easily adjusting the angle of the flexible arm.

Another object of the present invention is to provide a self-illumination glove, wherein a light source is adapted for incorporating with the glove to provide sufficient illumination in poor visibility or dim conditions.

Another object of the present invention is to provide a self-illumination glove, wherein the orientation of the light project from the light head can be selectively adjusted according to the user's preference.

Another object of the present invention is to provide a self-illumination glove, wherein the light head is adjustable to prevent the light from being blocked by the hand movement of the user.

Another object of the present invention is to provide a self-illumination glove, which can illuminate the target between narrow gap that only the user's hand can reach through.

Another object of the present invention is to provide a self-illumination glove, wherein the weight of the light source device is relatively light and it could be avoiding unnecessary encumbrance for the user.

Another object of the present invention is to provide a self-illumination glove, wherein the illumination device is detachable and easily for the user to load or unload it from the glove.

Accordingly, in order to accomplish the above objects, the present invention provides a self-illumination glove which comprises a glove body which is adapted for being worn by a hand of a user, and an illumination unit.

The glove body comprises a dorsum side, a palm portion, and a finger portion which is extended therefrom to define a knuckle portion between the palm portion and the finger portion. The dorsum side of the glove body has an inner glove layer and an outer glove layer overlapped thereon to retain the illumination unit between the inner and outer glove layers, wherein the outer glove layer has a through slot provided at the knuckle portion of the dorsum side.

The illumination unit comprises a power source supported at the dorsum side of the glove body at the palm portion, a light head adapted for generating a light beam at a direction towards the finger portion, and a flexible arm extended from the power source to the light head at a position that the light head is extended above the dorsum side of the glove body through the through slot, wherein the flexible arm is selectively bent to adjust an orientation of the light head so as to adjust the direction of the light beam for preventing the light beam being blocked by a hand movement of the user.

These and other objectives, features, and advantages of the present invention will become apparent from the following detailed description, the accompanying drawings, and the appended claims.

DETAILED DESCRIPTION OF THE PREFERRED EMBODIMENT

Figure 1:
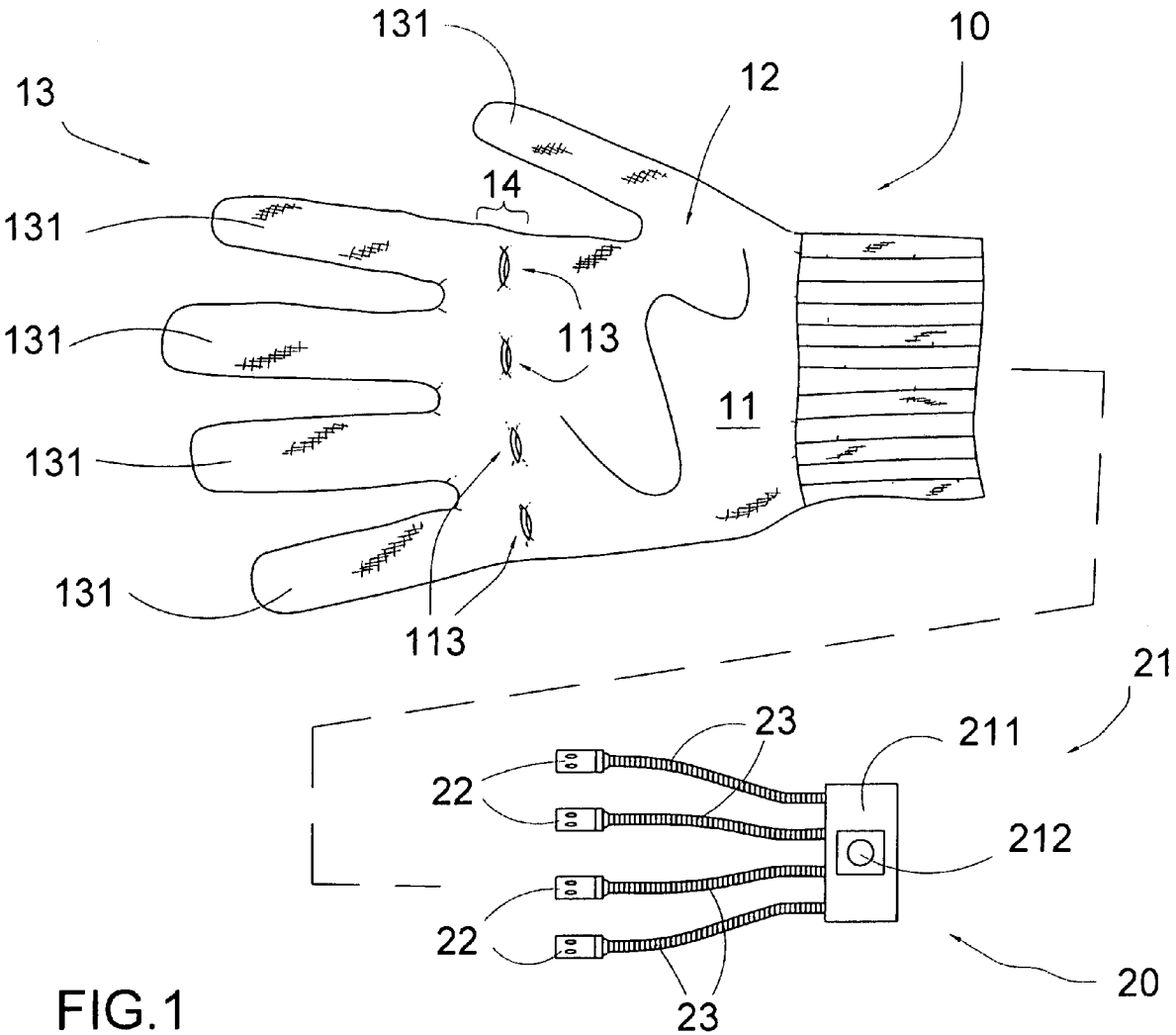
FIG. 1 is a perspective view of a self-illumination glove according to a preferred embodiment of the present invention.
Figure 2:
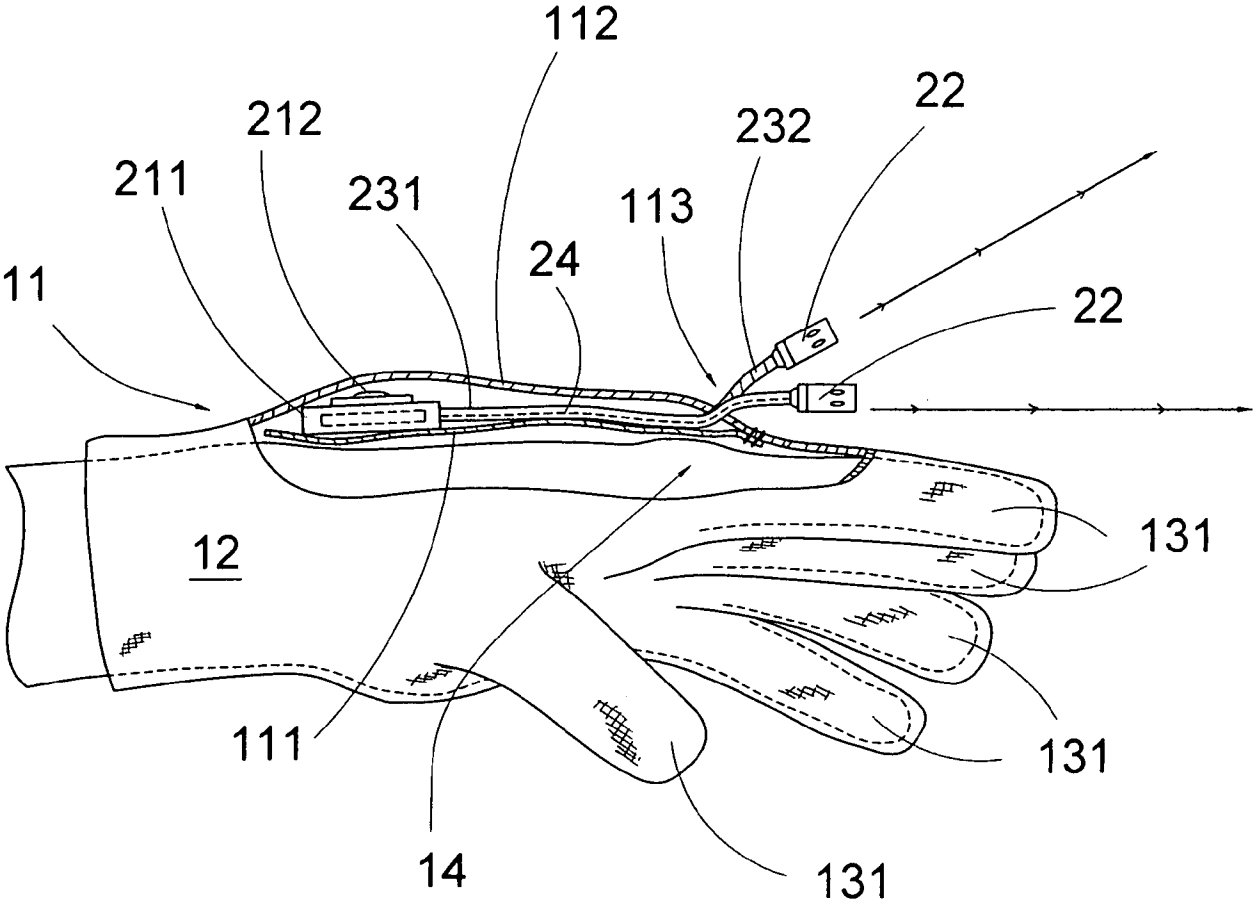
FIG. 2 is a cross-sectional view of the self-illumination glove according to the above preferred embodiment of the present invention.

Referring to FIGS. 1 and 2 drawings, a self-illumination glove according to preferred embodiment of the present invention is illustrated, wherein the self-illumination glove comprises a glove body 10 and an illumination unit 20.

The glove body 10, which is adapted for being worn by a hand of a user, has a dorsum side 11, a palm portion 12, and a finger portion 13 extending therefrom to define a knuckle portion 14 between the dorsum side 11 of the palm portion 12 and the finger portion 13. Preferably, the finger portion 13 comprises five finger pockets 131 to receive the fingers of the hand. Additionally, a finger pocket and a thumb pocket could be in the form as two finger pockets or any kinds nowadays are used (not shown in the drawing).

The illumination unit 20 comprises a power source 21 supported at the dorsum side 11 of the glove body 10 at the palm portion 12, and a light head 22 adapted for generating a light beam at a direction towards the finger portion 13 that the direction of the light beam is aligned with the axis of the finger portion 13 of the glove body 10.

The illumination unit 20 further comprises a flexible arm 23 extended from the power source 21 toward and connected to the light head 22 at a position that the light head 22 is extended above the dorsum side 11 of the glove body 10 at the palm portion 12. The light head 22 is suspendedly supported at the knuckle portion 14 of the glove body 10 at the dorsum side 11, wherein the flexible arm 23 is selectively bent to adjust the orientation of the light head 22 so as to adjust the direction of the light beam for preventing the light beam being blocked by a hand movement of the user.

It is worth to mention that if the light head 22 is located at the palm portion of the glove as designed in the conventional glove, the hand movement of the user will block the light beam of the light head 22. If the light head 22 is located at the finger portion of the glove, the orientation of the light head 22 is kept moving in responsive to the finger movement of the user. The above mentioned drawbacks can be solved in the present invention. Accordingly, since the light head 22 is suspendedly supported at the knuckle portion 14 of the glove body 10 at the dorsum side 11, the light beam of the light head 22 will not be blocked by the hand movement. In addition, the user is able to adjust the orientation of the light head 22 by adjustably bending the flexible arm 23 to achieve the optimum illumination angle of the light head 22.

The illumination unit 20 further comprises an electric cable 24 electrically extended from the power source 21 to the light head 22 through an interior of the flexible arm 23 as shown in FIG. 2. In other words, the flexible arm 23 has a hollow structure for the electric cable 24 extending therethrough to electrically connect the light head 22 with the power source 21. Accordingly, the electrical connection between the light head 22 and the power source 21 through the electric cable 24 can be protected by the flexible arm 23 to avoid power failure even though the flexible arm 23 is bent.

The power source 21 comprises a battery housing 211 for retaining a replaceable battery therein and a contact switch 212 which is operatively provided at the dorsum side 11 of the glove body 10 at the palm portion 12 to control the light head 22 in an on-and-off manner and is arranged in such a manner that when a pressing force is applied at the contact switch 212, the light head 22 is activated for generating the light beam. Preferably, the power source 21 is located closed to the wrist of the glove body 10, so it could reduce the opportunity that the power source 21 impacts with machines or tools due to the hand movement or action during the work period. In addition, the user is able to activate/deactivate the light head 22 by tapping the contact switch 212 on the body of the user or other surface to apply the pressing force at the contact switch 212.

Accordingly the light head 22 can be a LED light or a spot light depending on the different purposes of the user. Preferably, the light head 22 is a LED light because of low heat generation and low energy consumption.

Figure 3:
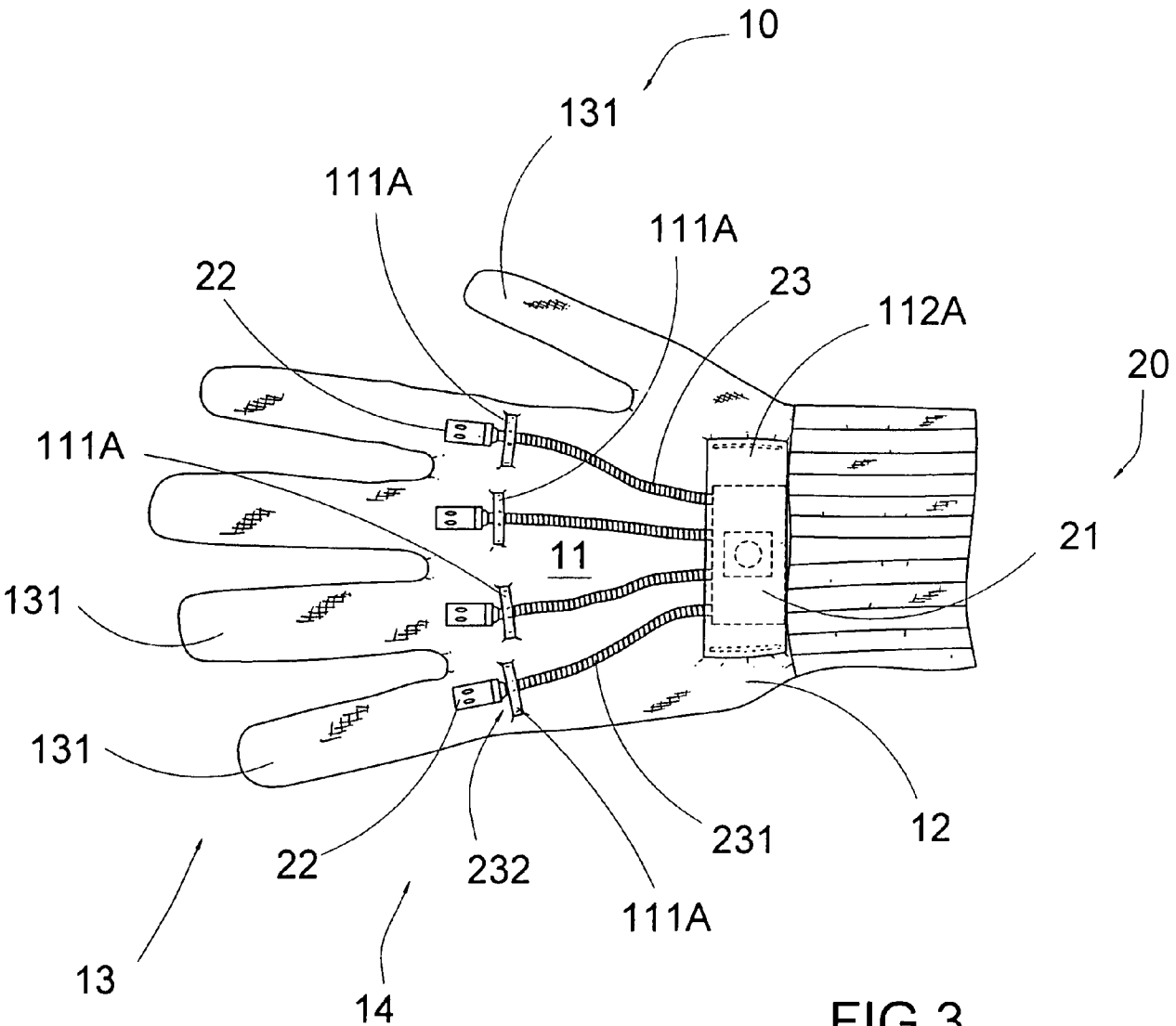
FIG. 3 illustrates an alternative mode of the glove body of the self-illumination glove according to above preferred embodiment of the present invention.

According to the preferred embodiment, the flexible arm 23 comprises a retention portion 231 and a bendable portion 232, as shown in FIG. 3. The retention portion 231 of the flexible arm 23 extended along the dorsum side 11 of the glove body 10 at the palm portion 12 and the bendable portion 232 of the flexible arm 23 extended above the dorsum side 11 of the glove body 10 at the palm portion 12 such that the light head 22 is selectively adjusted the orientation of the light beam when the bendable portion 232 of the flexible arm 23 is adjustably bent. In other words, the bendable portion 232 of the flexible arm 23 is protruded out from the dorsum side 11 to make the orientation of the light beam adjustable.

In addition, the retention portion 231 of the flexible arm 23 is retractable such that the length of the flexible arm 23 can be selectively adjusted. In other words, the flexible arm 23 is constructed by two different portions to obtain the retractable feature and bendable feature.

The dorsum side 11 of the glove body 10 has an inner glove layer 111 and an outer glove layer 112 overlapped thereon to retain the illumination unit 20 between the inner glove layer 111 and the outer glove layers 112. The outer glove layer 112 has a through slot 113 provided thereon, wherein the retention portion 231 of the flexible arm 23 is extended between the inner glove layer 111 and the outer glove layer 112 and the bendable portion 232 of the flexible arm 23 protrudes out of the outer glove layer 112 through the through slot 113 to couple with the light head 22 which is suspendedly supported at the knuckle portion 14 of the glove body 10 at the dorsum side 11 thereof.

According to the preferred embodiment, there are four flexible arms 23 spacedly extended from the power source 21 to align with the four finger pockets 131 respectively, wherein the bendable portions 232 of the flexible arms 23 are extended out of the outer glove layer 112 through the through slots 113 respectively. Four light heads 22 are coupled with the flexible arms 23 respectively, as shown in FIG. 1. Therefore, the user is able to selectively adjust all four light heads 22 at different orientations according to the user's preference.

It is worth to mention that the components of the illumination unit 20 are simple, portable and relatively light, so it could be avoiding unnecessary encumbrance for the user when the illumination unit 20 is located between the inner glove layer 111 and the outer glove layer 112 of the of the dorsum side 11 of the glove body 10.

FIG. 3 illustrates an alternative mode of the glove body 10 to retain the illumination unit in position. The glove body 10 comprises an elastic loop 111A and an elastic pocket 112A spacedly provided on the dorsum side 11 of the glove body 10 at the palm portion 12 for detachably retaining the illumination unit 20. Accordingly, the power source 21 is retained in the elastic pocket 112A while the flexible arm 23 is extended through the elastic loop 111A.

Both the elastic loop 111A and the elastic pocket 112A are made of elastic bands with different sizes for providing elastic holding forces against the flexible arm 23 and the power source 21. It is worth to mention that the retention portion 231 of the flexible arm 23 is defined at a portion thereof between the elastic loop 111A and the elastic pocket 112A while the bendable portion 232 of the flexible arm 23 is defined at a portion thereof between the elastic loop 111A and the light head 22. The elastic loop 111A and the elastic pocket 112A will make the user easily to load and unload the illumination unit 20 into the glove body 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A self-illumination glove, comprising:

a glove body which is adapted for being worn by a hand of a user, having a dorsum side, a palm portion, and a finger portion which is extended therefrom to define a knuckle portion between said palm portion and said finger portion; and an illumination unit, which comprises:

a power source supported at said dorsum side of said glove body at said palm portion thereof;

a light head adapted for generating a light beam at a direction towards said finger portion of said glove body, wherein said light head is extended above said dorsum side of said glove body at a position that said light head is suspendedly supported above said knuckle portion of said glove body; and a flexible arm extended from said power source to said light head at a position that said light head is extended above said dorsum side of said glove body, wherein said flexible arm is selectively bent to adjust an orientation of said light head so as to adjust the direction of said light beam for preventing said light beam being blocked by a hand movement of said user, wherein said flexible arm has a retention portion extended from said power source at a position underneath said dorsum side of said glove body, and a bendable portion extended above said dorsum side of said glove body to support said light head, such that said bendable portion of said flexible arm is selectively bent to adjust said orientation of said light head so as to adjust the direction of said light beam.

2. The self-illumination glove, as recited in claim 1, wherein said dorsum side of said glove body has an inner glove layer and an outer glove layer overlapped thereon, wherein said flexible arm is extended from said power source to said light head at a position between said inner and outer glove layers.

3. The self-illumination glove, as recited in claim 2, wherein said retention portion of said flexible arm is extended between said inner and outer glove layers while said bendable portion of said flexible arm is extended out of said outer glove layer to support said light head above said dorsum side of said glove body.

4. The self-illumination glove, as recited in claim 2, wherein said outer glove layer has a through slot provided thereon for said bendable portion of said flexible arm extending out of said outer glove layer.

5. The self-illumination glove, as recited in claim 3, wherein said outer glove layer has a through slot provided thereon for said bendable portion of said flexible arm extending out of said outer glove layer.

6. The self-illumination glove, as recited in claim 1, wherein said glove body comprises an elastic loop and an elastic pocket spacedly provided on said dorsum side of said glove body, wherein said power source is detachably received in said elastic pocket while said flexible arm is extended through said elastic loop to support said light head.

7. The self-illumination glove, as recited in claim 3, wherein said glove body comprises an elastic loop and an elastic pocket spacedly provided on said dorsum side of said glove body, wherein said power source is detachably received in said elastic pocket while said flexible arm is extended through said elastic loop to support said light head.

8. The self-illumination glove, as recited in claim 5, wherein said glove body comprises an elastic loop and an elastic pocket spacedly provided on said dorsum side of said glove body, wherein said power source is detachably received in said elastic pocket while said flexible arm is extended through said elastic loop to support said light head.

9. The self-illumination glove, as recited in claim 6, wherein said glove body comprises an elastic loop and an elastic pocket spacedly provided on said dorsum side of said glove body, wherein said power source is detachably received in said elastic pocket while said flexible arm is extended through said elastic loop to support said light head.

10. The self-illumination glove, as recited in claim 5, wherein said retention portion of said flexible arm is a portion extended from said elastic pocket to said elastic loop while said bendable portion of said flexible arm is a portion extended from said elastic loop to said light head.

11. The self-illumination glove, as recited in claim 6, wherein said retention portion of said flexible arm is a portion extended from said elastic pocket to said elastic loop while said bendable portion of said flexible arm is a portion extended from said elastic loop to said light head.

12. The self-illumination glove, as recited in claim 9, wherein said retention portion of said flexible arm is a portion extended from said elastic pocket to said elastic loop while said bendable portion of said flexible arm is a portion extended from said elastic loop to said light head.

13. The self-illumination glove, as recited in claim 6, wherein said power source comprises a battery housing for retaining a replaceable battery therein and a contact switch operatively provided at said dorsum side of said glove body at said palm portion thereof to control said light head in an on-and-off manner such that when a pressing force is applied at said contact switch, said light head is activated for generating said light beam.

14. The self-illumination glove, as recited in claim 9, wherein said power source comprises a battery housing for retaining a replaceable battery therein and a contact switch operatively provided at said dorsum side of said glove body at said palm portion thereof to control said light head in an on-and-off manner such that when a pressing force is applied at said contact switch, said light head is activated for generating said light beam.

15. The self-illumination glove, as recited in claim 12, wherein said power source comprises a battery housing for retaining a replaceable battery therein and a contact switch operatively provided at said dorsum side of said glove body at said palm portion thereof to control said light head in an on-and-off manner such that when a pressing force is applied at said contact switch, said light head is activated for generating said light beam.

16. The self-illumination glove, as recited in claim 9, wherein said light head is a light device selected from the group consisting of LED light and spot light.

17. The self-illumination glove, as recited in claim 12, wherein said light head is a light device selected from the group consisting of LED light and spot light.

18. The self-illumination glove, as recited in claim 15, wherein said light head is a light device selected from the group consisting of LED light and spot light.

* * * * *